US006742730B2

(12) United States Patent
Kassanits

(10) Patent No.: US 6,742,730 B2
(45) **Date of Patent: *Jun. 1, 2004**

(54) SPRAY NOZZLE WITH IMPROVED ASYMMETRICAL FLUID DISCHARGE DISTRIBUTION

(75) Inventor: Richard Kassanits, West Chicago, IL (US)

(73) Assignee: Spraying Systems Co., Wheaton, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/967,417

(22) Filed: Sep. 28, 2001

(65) Prior Publication Data

US 2002/0030126 A1 Mar. 14, 2002

Related U.S. Application Data

(63) Continuation-in-part of application No. 09/491,344, filed on Jan. 26, 2000.

(51) Int. Cl.[7] ..... B05B 1/00

(52) U.S. Cl. ..... 239/597; 239/598; 239/599; 239/601

(58) Field of Search ..... 239/597, 598, 239/599, 601; 137/802

(56) References Cited

U.S. PATENT DOCUMENTS 2,619,388 A 11/1952 Wahlin
2,683,626 A 7/1954 Wahlin
2,774,631 A 12/1956 Wahlin
2,778,687 A 1/1957 Hegstad
2,778,688 A 1/1957 Corl
2,964,248 A 12/1960 O'Brien et al.
2,971,250 A 2/1961 Wahlin
3,697,313 A * 10/1972 Stumphauzer et al. ..... 239/601
3,737,108 A 6/1973 Stumphauzer et al.
3,843,055 A 10/1974 Nord et al.
4,346,849 A 8/1982 Rood

* cited by examiner

*Primary Examiner*—Christopher Kim
(74) *Attorney, Agent, or Firm*—Leydig Voit & Mayer Ltd.

(57) ABSTRACT

A spray nozzle for producing an asymmetrically distributed fluid discharge pattern such as for use in a container coating application is provided. The spray nozzles includes a body portion having an internal fluid passageway which terminates in a substantially hemispherical dome shaped end wall. A discharge orifice is provided in the end wall which is produced by superimposing on each other an approximately round opening and an elongated opening having opposed rounded ends. The round opening and the elongated opening defining respective edges of the discharge orifice which extend at different angles relative to a longitudinal axis of the fluid passageway. The resulting orifice produces a fluid discharge pattern wherein the amount of fluid discharged tapers in a continuous, non-linear manner from the location of maximum discharge to points of minimum flow at either end of the discharge pattern.

9 Claims, 9 Drawing Sheets

SPRAY NOZZLE WITH IMPROVED ASYMMETRICAL FLUID DISCHARGE DISTRIBUTION

CROSS-REFERENCE TO RELATED PATENT APPLICATION

This patent application is a continuation-in-part of U.S. patent application Ser. No. 09/491,344 filed Jan. 26, 2000.

FIELD OF THE INVENTION

The present invention relates to spray nozzles and, more particularly to a spray nozzle, such as for use in container coating applications, which produces an improved asymmetrical distribution of the fluid discharge.

BACKGROUND OF THE INVENTION

In order to protect substances such as food and beverages from contamination, a coating is typically applied to the inside surfaces of containers in which such substances are stored. This coating prevents the contents of the container from coming into direct contact with the bare metal or plastic interior surfaces of the container. With standard cylindrical containers or cans, this coating is generally applied to the interior of the container before the top is affixed through the use of a spray nozzle which is arranged to discharge through the open end of the container. As the coating is being discharged from the nozzle, the container is rotated about its longitudinal axis so as to ensure that all of the interior surfaces are coated.

The coating material used on the inside surfaces of the containers represents one of the most significant costs associated with a container manufacturing operation. Accordingly, in order to minimize consumption of the coating material, it is desirable to utilize a spray nozzle which produces a tightly controlled spray pattern which applies a thin, even coating on the interior surfaces of the container while minimizing the amount of spray that does not contact the interior of the container. Additionally, since the containers can have a wide variety of sizes it is also desirable that the spray nozzles be easily customized to provide a tightly controlled pattern for a particular container configuration.

To help achieve an even coating, the coating material is generally applied using spray nozzles that are configured to produce an asymmetrical distribution of the fluid discharge. These nozzles are arranged at an angle relative to the longitudinal axis of the container so that the heaviest portion of the discharge is directed towards the far, closed end of the container. Thus, the asymmetrical distribution helps compensate for the greater distance the coating material must travel to reach the closed end of the container and, in turn, the greater surface area of the interior of the container that this portion of the discharge pattern must cover.

One common method by which to measure the distribution of the fluid discharge of a particular nozzle is to discharge the nozzle onto what is referred to as a distribution table. The distribution table has on its upper surface a plurality of evenly spaced troughs that have relatively sharp edges which divide the spray into segments and then channel the liquid sprayed into them into test tubes or graduated cylinders for measurement. The spray nozzle is generally oriented relative to the distribution table so that the spray nozzle points downward towards the table with the centerline of the orifice being perpendicular to the surface of the table. The nozzle is centered on one trough and is located at some predetermined distance above the table. For nozzles which produce a flat, fan type spray pattern, including those typically used in container coating applications, the nozzle is arranged so that the widest portion of the fan extends perpendicularly relative to the troughs.

With the asymmetrical pattern spray nozzles presently used in container coating applications, it has been difficult to achieve a thin, even coating on the interior of the containers which avoids waste of the coating material. For example, one type of nozzle which can produce an asymmetrical spray pattern is what is referred to as a drumhead nozzle. A drumhead type nozzle has a discharge orifice configured to produce a fan-shaped discharge pattern with a maximum amount of fluid being discharged at one end of the fan and with the amount of fluid decreasing linearly to a minimum amount at the other end of the fan. With this type of distribution pattern, however, drumhead type nozzles cannot produce a thin, even coating along the bottom of the container and at the intersection between the bottom and the cylindrical side wall of the container. Accordingly, to ensure that all of these surfaces are adequately coated, extra coating material must be applied and, as a result, deposits of excess coating material form in some areas.

Another spray nozzle configuration which can be used in container coating applications is described in U.S. Pat. Nos. 3,697,313 and 3,737,108. In contrast to the drumhead type nozzle which has the maximum discharge at or closely adjacent one end of the spray fan, this type of nozzle produces a discharge pattern where the heaviest discharge or flow of fluid is produced at a point approximately midway between the middle and one end of the total fan-shaped pattern produced by the nozzle. With this type of nozzle, the level or amount of discharge tapers linearly from the location of maximum discharge to either end of the spray pattern. The discharge orifice in the nozzle is produced by making two separate cuts in a dome-shaped end of a cylindrical blank nozzle body using sharply pointed rotary cutting wheels. The resulting orifice has sharply pointed ends and expands to a maximum opening that is arranged asymmetrically between the sharply pointed ends of the orifice.

However, like the drumhead type nozzles, this type of nozzle cannot apply a thin, even coat on the all of the interior surfaces of the container resulting in inefficient consumption of the coating material, which, in turn, results in increased manufacturing costs for the containers.

OBJECTS AND SUMMARY OF THE INVENTION

Accordingly, in view of the foregoing, it is a general object of the present invention to provide a spray nozzle, such as for use in container coating applications, which produces an improved asymmetrical distribution of the fluid discharge.

A related object of the present invention is to provide a spray nozzle as characterized above which can be easily customized for use with containers having different configurations.

These and other features and advantages of the invention will be more readily apparent upon reading the following description of a preferred exemplary embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENT

Figure 1:
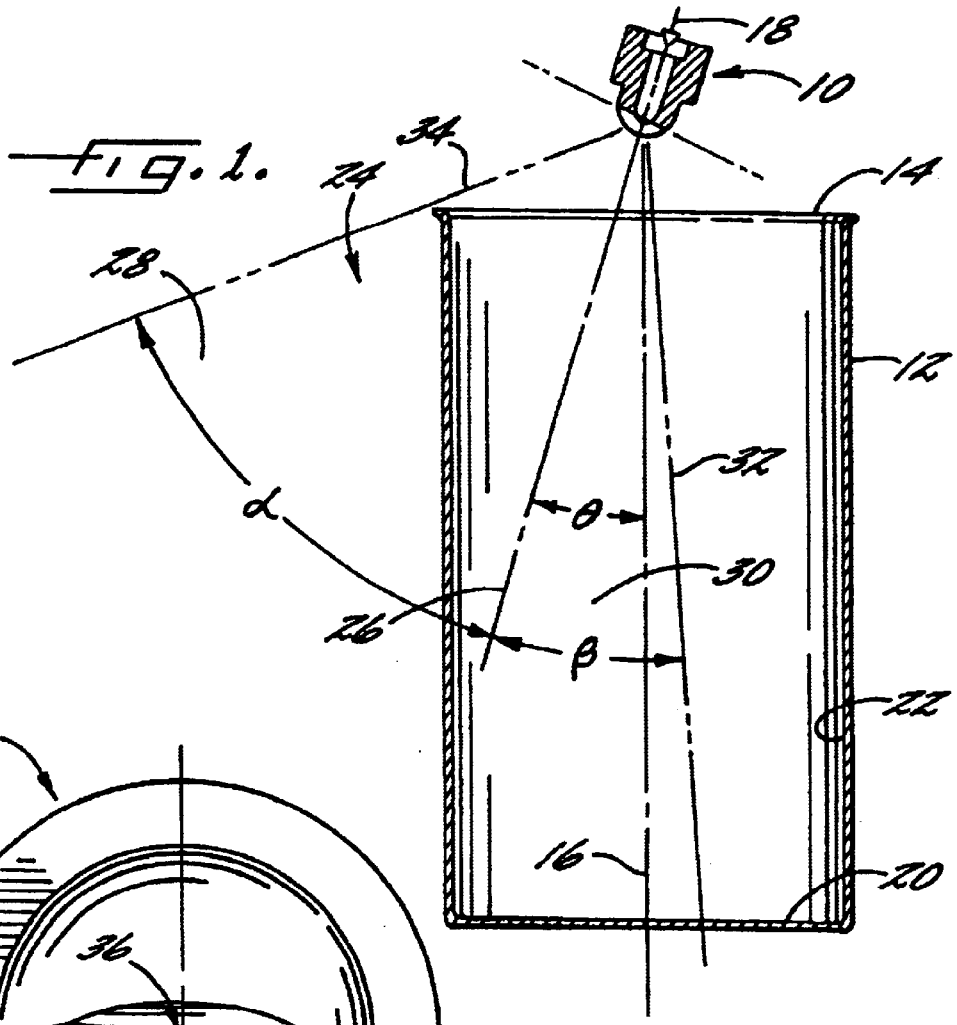
FIG. 1 is a schematic longitudinal section view of a container coating station incorporating an illustrative spray nozzle for producing an asymmetrically distributed fluid discharge pattern which incorporates the features of the present invention.
Figure 2:
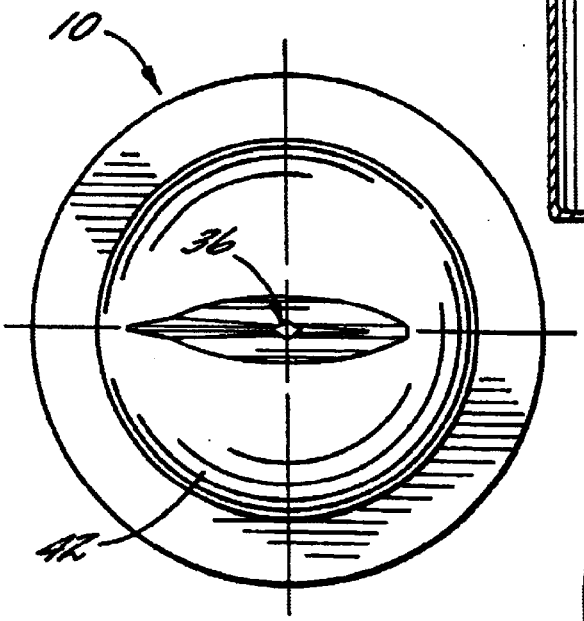
FIG. 2 is a top plan view of the illustrative spray nozzle assembly.
Figure 3:
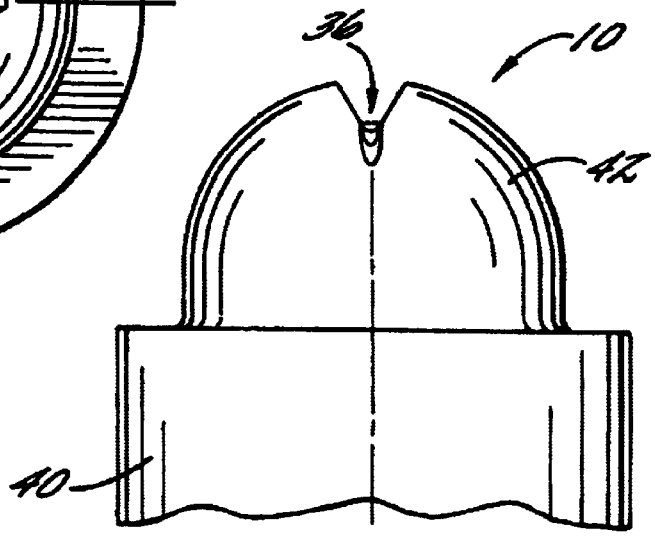
FIG. 3 is a side elevation view of the illustrative spray nozzle assembly.

Referring now more particularly to FIG. 1, there is schematically shown, a portion of an exemplary container coating station that includes a spray nozzle 10 embodying the present invention which discharges, in this case, a coating material fluid in an asymmetrically distributed pattern. More specifically, the spray nozzle 10 is configured so as to produce a flat fan shaped pattern in which the heaviest discharge is shifted from the center towards one end of the fan pattern. With the illustrated container coating station, open-ended containers 12 are indexed one-by-one to the coating station where the stationary spray nozzle 10 applies a coating material onto the interior surfaces of the container 12 through the open end 14. The coating material may comprise vinyl, epoxy, acrylic or other suitable materials. As the coating material is being applied, the container 12 is rotated about its longitudinal axis 16 relative to the spray nozzle 10 at a relatively high speed (e.g., 500–3000 rpm) so that the coating material is applied to the entire interior of the container. As will be understood by those skilled in the art, while the spray nozzle of the present invention is described in connection with a container coating application, it may be employed in other applications and systems where a asymmetrical fluid discharge pattern is desired.

To facilitate application of the coating material, the spray nozzle 10 is disposed on the longitudinal axis 16 of the container 12 a short distance from the open end 14 of the container as shown in FIG. 1. Additionally, the spray nozzle 10 is canted such that the centerline 18 of the nozzle is disposed at an angle θ relative to the longitudinal axis 16 of the container, which, in this case, is oriented substantially horizontal. As explained in greater detail below, to compensate for the greater distance the coating material must travel to reach the closed end of the container 12, the spray nozzle 10 is arranged so that the portion of the spray pattern with the heaviest discharge is directed generally towards the intersection of the bottom wall 20 and cylindrical side wall 22 of the container. As will be appreciated by those skilled in the art, the angle θ of the spray nozzle 10 relative to the longitudinal axis 16 of the container can vary depending on the configuration of the container 12 being coated. In most instances, however, the spray nozzle 10 is preferably arranged at an angle θ of approximately 5° to 20° relative to the longitudinal axis 16 of the container.

In accordance with one important aspect of the present invention, the spray nozzle 10 is configured so as to produce an improved asymmetrical distribution of the fluid discharge as compared to prior art nozzles used for container coating. In particular, prior art nozzles used in container coating applications are configured to produce a discharge pattern in which the amount of discharge tapers linearly from the location of maximum discharge to either end of the spray pattern. It has been found, however, that a linear taper of the distribution amount results in an excess amount of coating material being applied to the sides of the interior of the container. In contrast, the spray nozzle 10 of the present invention has a discharge orifice which is configured to produce a tightly controlled asymmetrical fluid discharge distribution in which the amount of fluid distributed to either side of the area of maximum flow is less than with prior art nozzles. Thus, with the spray nozzle 10 of the present invention, the amount of flow tapers continuously in a non-linear manner from the area of maximum flow to the points of minimum flow at either end of the spray pattern. As a result, the spray nozzle 10 is capable of applying a thin, even coat of a coating material on the interior surfaces of the container 12. Accordingly, the spray nozzle 10 optimizes consumption of the coating material resulting in a significant reduction in the costs associated with manufacturing containers.

Figure 5:
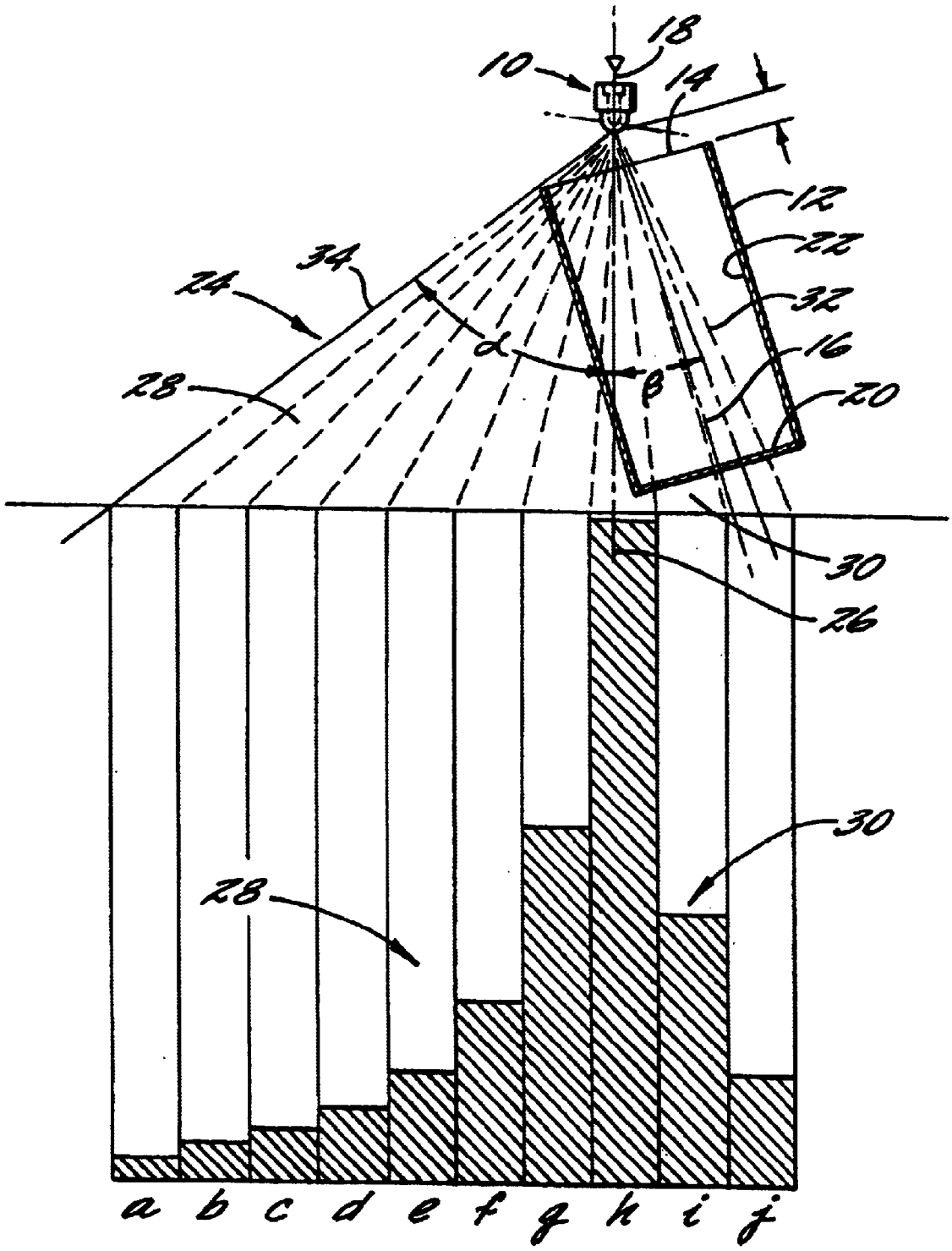
FIG. 5 is a schematic drawing illustrating a desired fluid distribution pattern for the illustrative spray nozzle assembly when utilized in a container coating application.

To this end, a preferred optimal distribution pattern 24 for the spray nozzle 10 is schematically shown in FIG. 5. In FIG. 5, the amount of flow at different points in the spray pattern or fan 24 is illustrated by the shaded areas in the troughs a–j. With this distribution pattern 24, the maximum amount of fluid is discharged at a point (trough h in the illustrated embodiment) approximately midway from the center and one end of the fan thereby dividing the discharge pattern into a larger portion 28 and a smaller portion 30. From the point of maximum discharge, the amount of fluid discharged tapers in a non-linear manner to minimum discharge points at either end of the spray fan 24 (trough a and trough j in FIG. 5). The amount of fluid that is discharged in each of the troughs is directly proportional to the surface area of the portion of the container 12 that is intended to be covered by that portion of the spray fan 24. In FIG. 5, the segment of the interior surface of the container 12 that corresponds to each of the troughs is shown by the broken line extensions of the trough walls back to the discharge orifice of the spray nozzle 10. Thus, when a spray nozzle configured to produce the distribution pattern 24 shown in FIG. 5 is oriented properly with respect to the container 10, an even coat of the sprayed material is produced on the entire interior surface of the container. As will be appreciated from FIG. 5, the additional coating material which is discharged in troughs a–g so as to produce the linear rise to the point of maximum discharge found in the prior art container coating nozzles results in a significant amount of excess coating material being applied to the side wall of the container.

To ensure an even coat and avoid wasted spray, the spray nozzle 10 is preferably oriented with regard to the container such that the edge 32 of the smaller portion 30 of the spray fan 24 is directed at a point slightly beyond the center of the bottom wall 20 of the container and the edge 34 of the larger portion 28 of the spray fan is directed at the edge of the open end 14 of the container 12, as shown in FIGS. 1 and 5. In particular, any portion of the spray fan 24 which extends beyond the edge of the open end 14 of the container 10 does not contact the container and is therefore wasted. Likewise, any portion of the spray fan 24 which extends beyond the center of the bottom wall 20 of the container 12 is sprayed in excess. The spray nozzle 10 is also preferably oriented so that the portion of the spray fan 24 having the heaviest discharge (referenced by the line 26), which in the illustrated embodiment also coincides with the centerline 18 of the spray nozzle 10, is directed towards the lower portion of the side wall 22 of the container 12 adjacent the intersection of the bottom and side walls 20, 22 of the container as shown in FIG. 5. For ease of reference, in FIGS. 1 and 5, the position of the outer edge 34 of the larger portion 28 of the spray fan 24 relative to the point of heaviest discharge (line 26) is represented by angle a and the position of the outer edge 32 of the smaller portion 30 of the spray fan relative to the point of the heaviest discharge is represented by the angle $\beta$.

Figure 4:
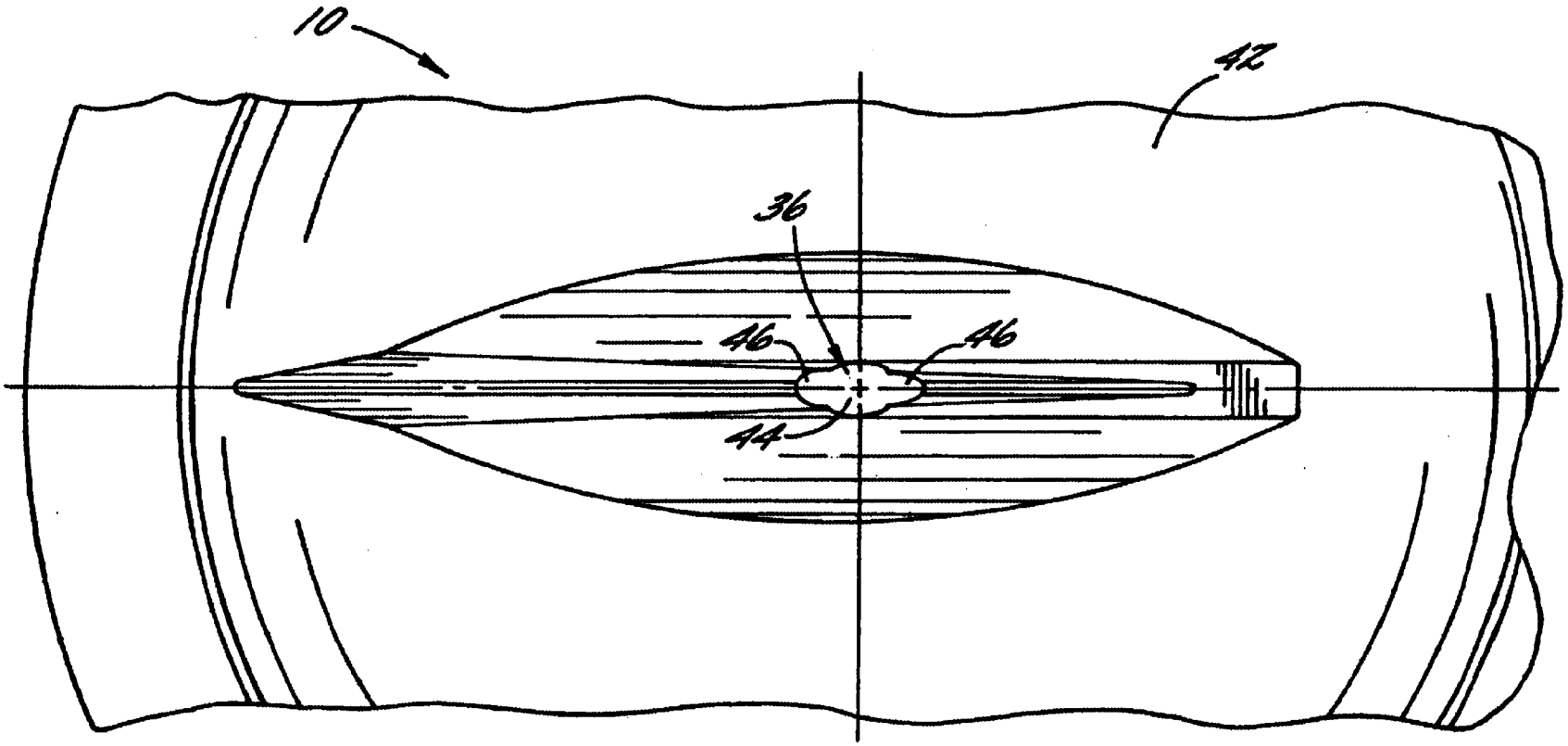
FIG. 4 is an enlarged top plan view of the discharge orifice of the illustrative spray nozzle assembly.
Figure 6:
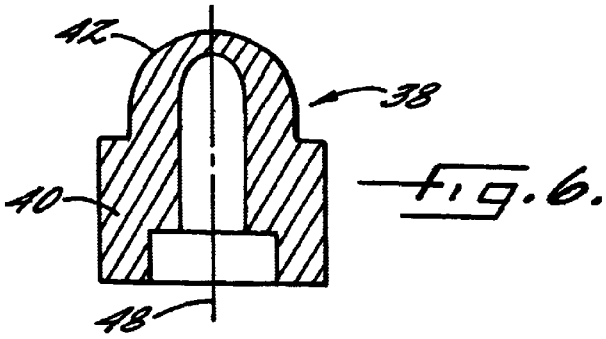
FIG. 6 is a cutaway side elevation view of an illustrative nozzle blank for use in producing the illustrative spray nozzle assembly.

In carrying out the invention, to produce a spray pattern having the desired asymmetrical distribution of the fluid discharge and the desired configuration (e.g., desired angles $\alpha$ and $\beta$), the spray nozzle includes a discharge orifice 36 which is produced by performing, in this case, two separate cutting operations on a nozzle blank 38 having a cylindrical side wall 40 and a dome shaped end wall 42 (shown in FIG. 6). As shown in FIG., 4, these cutting operations yield a discharge orifice 36 comprising an approximately circular or opening and a relatively narrower elongated opening superimposed or overlaid on each other. The resulting discharge orifice 36 has a relatively wider intermediate portion 44 having opposed edges from which extends a pair of relatively narrower opposed notch portions 46 as shown in FIG. 4 (as will be appreciated, when enlarged and viewed from above as in FIG. 4 the ends of the notch portions appear rounded because the cutter is not perfectly sharp and the material is not perfectly cuttable). The notch portions 46 have respective edges which extend to form rounded ends of the orifice with one of the notch portions being relatively larger than the other as shown in FIG. 4. As will be appreciated by those skilled in the art, the present invention is not limited to spray nozzles which produce the exact discharge pattern shown in FIG. 5. Instead, all that is necessary to improve upon the performance of the prior art nozzles is to configure the spray nozzle 10 such that the discharge levels on either side of the area of maximum discharge are lowered to the point that the discharge levels taper in a non-linear manner to the points of minimum flow at either end of the spray fan 24.

Each of the two cutting operations are centered on and performed in the same plane as the longitudinal axis 48 of the nozzle blank 38. The two cutting operations, however, are performed using cutting implements having different cross-sectional profiles and extend through the blank 38 at different angles relative to the longitudinal axis 48 of the nozzle blank. For ease of reference, the two cutting operations will be referred to as first and second cutting operations. However, it will be appreciated that the cutting operations can be performed in any order. In the illustrated embodiment, the cutting operations are performed using rotary cutting wheels having peripheral cutting edges that can be diamond charged or made of carbon for use in electric discharge machines. The cutting operations can be performed either by plunging the wheel into the nozzle blank 38 or by cutting across the nozzle blank.

With the discharge orifice formed in such a manner, it will be seen that a slot produced by the cutter 150, which forms the relatively rounder opening 144 of the discharge orifice, is oriented such that a line 149*a* extending longitudinally alone the bottom of the slot and through the axis of the longitudinal passageway of the nozzle body lies in a first plane and the slot formed by the cutting wheel 160, which defines the more elongated portion 146 of the discharge orifice, is oriented such that a line 146*a* extending longitudinally along the bottom of the second slot and through the axis of the longitudinal passageway of the nozzle body lies in a second plane extending at a greater angle to a perpendicular relative to the longitudinal axis of the internal liquid passageway than the plane of the line 149*a*.

Figure 7:
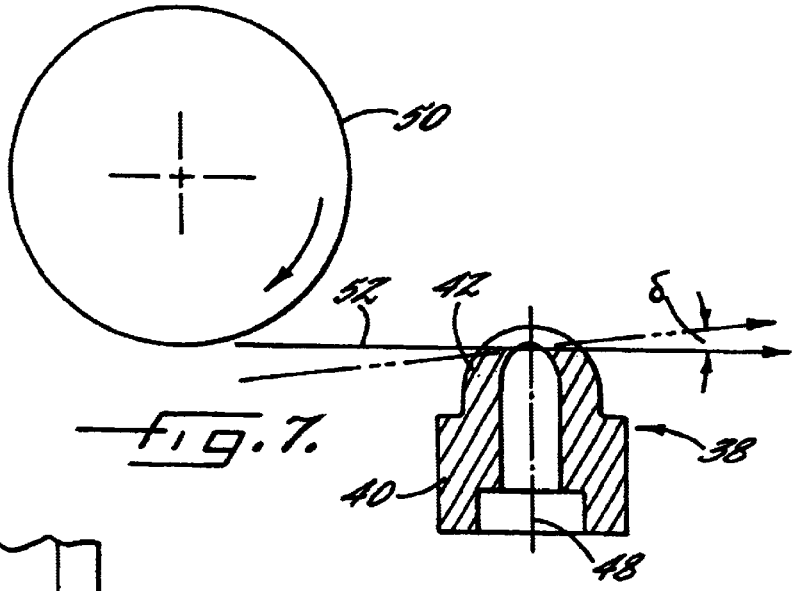
FIG. 7 is a schematic side elevation view showing a cutting path for a first cut used to produce the discharge orifice of the spray nozzle of FIG. 1.
Figure 9:
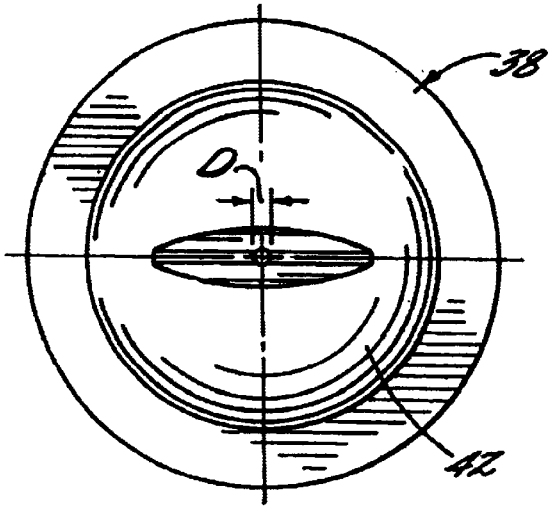
FIG. 9 is a top plan view showing the nozzle blank after completion of the first cut.

For the first cutting operation, a first rotary cutting wheel 50 having a cutting edge 54 configured to produce a substantially circular opening having a diameter D in the dome of the nozzle blank, as shown in FIG. 9, is used. As shown in FIG. 7, the first cutting operation can be executed either in a plane 52 perpendicular to the longitudinal axis 48 of the nozzle blank 38 or at some angle $\delta$ relative to perpendicular. The profile of the cutting edge 54 of the first cutting wheel 50 can be as simple as a straight flat which is used to remove a portion of the top 42 of the nozzle blank 38 at some point above where the domed top of the blank meets the cylindrical side wall 40. However, the use of a straight flat cutting edge in the first cutting operation creates a circular opening having a sharp, thin edge which wears very quickly. Since the sizes of the cuts, and in turn, the size of the resultant discharge orifice 36 are carefully calibrated to produce the desired spray pattern, any wear along the edges of the orifice will lead to a rapid increase in flow through the orifice and a resultant breakdown in the desired spray pattern.

Figure 8:
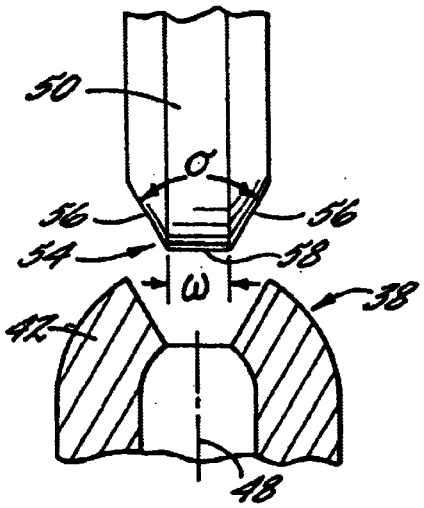
FIG. 8 is an enlarged partial side elevation view showing the cutting edge of the cutting wheel used to produce the first cut and the nozzle blank after completion of the first cut.

According to a further aspect of the present invention, to provide enhanced wear characteristics and therefore increased longevity, the first cut on the nozzle blank 38 is executed in such a manner so as to avoid the formation of any thin edges about the periphery of the orifice. In particular, as opposed to using a straight flat cutting edge profile, the first cutting wheel 50 can be configured with a cutting edge 54 having a profile that includes multiple angled portions. For example, one preferred embodiment of an angled profile cutting edge 54 for the first cutting wheel 50 is shown in FIG. 8. In FIG. 8, the cutting edge 54 has a pair of angled sides 56 (defining an included angle $\sigma$) which extend to a flat tip 58. By matching the size of the width of the tip W of the cutting edge 54 to the desired diameter D of the opening produced by the first cutting operation, the thin, rapidly wearing edges can be minimized.

Figure 10:
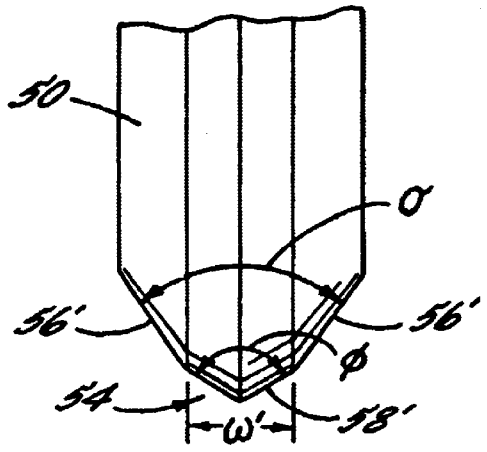
FIG. 10 is an enlarged partial side elevation view of the cutting edge of an alternative embodiment of a cutting wheel for producing the first cut.

Alternatively, as shown in FIG. 10, the first cutting wheel 50 could have a cutting edge 54' having a pair of angled sides 56' which taper to an angled tip 58' that defines an included angle $\phi$ which is greater than the included angle a defined by the angled sides 56'. With the cutting edge profile of FIG. 10, thin edges can be avoided by matching the width W' of the angled tip 58' to the desired diameter D of the opening produced by the first cutting operation. Using an angled tip on the cutting edge, as opposed to the flat tip of FIG. 9, causes the portion of the distribution pattern with the heaviest discharge to broaden. For example, with reference to FIG. 5, using an angled tip on the cutting edge will reduce the difference between the fluid levels in troughs g, h and i.

Figure 11:
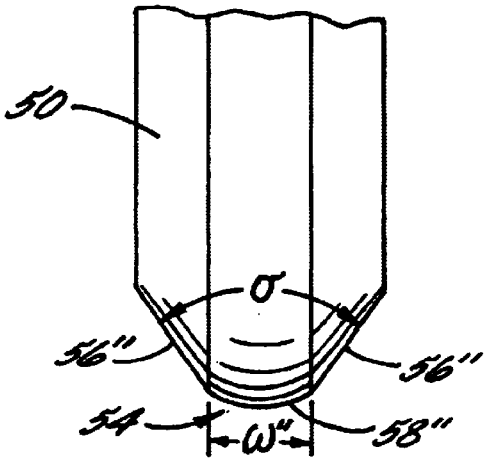
FIG. 11 is an enlarged partial side elevation view of the cutting edge of another embodiment of a cutting wheel for producing the first cut.

In yet another alternative embodiment, the first cutting wheel 50 could have a cutting edge 54" defined by a pair of angled sides 56" which taper to a rounded tip 58" as shown in FIG. 11. Similar to the embodiments of FIGS. 8 and 10, the width W" of the rounded tip 58" is matched to the desired diameter D of the opening produced by the first cutting operation. Likewise, similar to the FIG. 10 embodiment, decreasing the radius of the rounded tip 58" will cause the area of the heaviest discharge in the distribution pattern to broaden.

Figure 12:
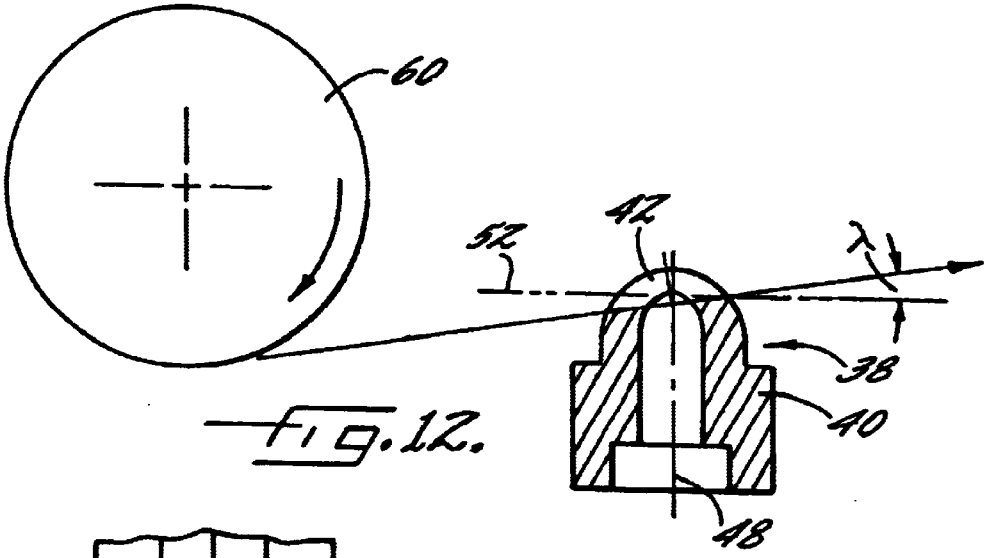
FIG. 12 is a schematic side elevation view showing a cutting path for a second cut used to produce the orifice of the illustrative spray nozzle.
Figure 13:
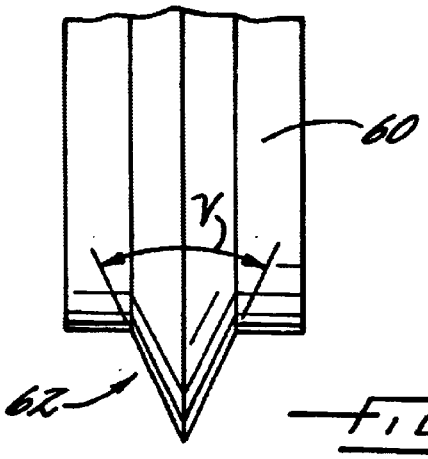
FIG. 13 is an enlarged partial side elevation view of the cutting edge of a cutting wheel for producing the second cut.

For the second cutting operation, a second rotary cutting wheel 60 having a cutting edge 62 which tapers to a sharp point, as shown in FIG. 12, is used. In the illustrated embodiment, the profile of the cutting edge 62 used for the second cut defines an included angle $\gamma$ which is approximately one half of the included angle defined by the angled sides 56, 56', 56" of the cutting edge used to produce the first cut. As with the first cutting operation, the second cut is centered on the longitudinal axis 48 of the nozzle blank 38. However, the second cut is performed at an angle relative to the plane in which the first cut is performed. In particular, as shown in FIG. 12, the second cut is made at an angle $\lambda$ relative to the plane 52 which extends perpendicular to the longitudinal axis 48 of the nozzle blank. If the first cut is done on an angle $\delta$ relative to the perpendicular, the second cut should be executed so that it is angled, in the same direction relative to perpendicular as the first cut. In such a case, however, the second cut should be at a larger angle than the first cut.

According to another aspect of the present invention, the configuration of the discharge orifice 36 can be easily adapted to customize the discharge pattern for containers having different configurations. For example, to adjust the total angle (angle $\alpha$ plus the angle $\beta$ in FIG. 5) of the spray pattern produced by the spray nozzle 10 so as to adapt the spray nozzle to handle containers of different diameters, the size or flow rate of the openings produced by the first and second cutting operations can be varied. As will be appreciated, one of the methods by which the size or flow rates produced by the two cutting operations can be varied is by adjusting the depth of the cuts. With a typical beverage container, when expressed in terms of the ratio of the flow rate produced by the first cut to the flow rate produced after the second cut, it is preferred that a ratio of approximately 0.60 be used. Configuring the nozzle discharge orifice 36 so that this ratio is larger will decrease the total spray angle ($\alpha+\beta$) produced by the spray nozzle 10. Conversely, lowering the ratio will increase the total spray angle ($\alpha+\beta$) produced by the spray nozzle 10.

In order to adjust the position of the point (represented by line 26) of heaviest discharge within the spray pattern, the angle $\delta$ at which the first cut is performed relative to the plane 52 which extends perpendicular relative to the longitudinal axis 48 of the nozzle blank 38 can be varied. In this way the spray nozzle 10, and in turn the distribution pattern 24, can be configured for containers having different heights. Specifically, as shown in FIG. 7, the first cut can be performed at an angle $\delta$ relative to perpendicular in order to shift the heaviest portion (line 26) of the distribution towards the edge 32 of the larger portion 28 of the spray pattern with respect to FIG. 5. By varying the angle $\delta$ at which the first cutting operation is performed, the distance that the heaviest portion of the distribution moves can be varied. Thus, in order to configure the spray nozzle 10 for coating a relatively shorter container, the angle $\delta$ of the first cut should be increased.

Moreover, the distribution pattern can be further calibrated by adjusting the angle $\lambda$ at which the second cut is performed as well as by adjusting the included angle $\gamma$ of the cutting edge 62 used for the second cutting operation. In particular, the relative sizes of the larger and smaller portions 28, 30 of the spray pattern (i.e. angles $\alpha$ and $\beta$ in FIG. 5) can be adjusted by varying the angle $\lambda$ at which the second cutting operation is performed. For instance, performing the second cut at a relatively smaller angle $\lambda$ will increase the size of the smaller portion 30 of the distribution pattern, making the overall pattern less asymmetrical. In addition, with all the other variables held constant, increasing the included angle $\gamma$ of the cutting edge 62 on the second cutting wheel 60 will increase the angle of the overall spray pattern (i.e. angle $\alpha$ plus angle $\beta$ in FIG. 5).

From the foregoing, it can be seen that the spray nozzle of the present invention produces an improved asymmetrical distribution of the fluid discharge. This improved distribution enables the nozzle of the present invention to optimize consumption of the relatively costly coating material. Moreover, the spray nozzle can be readily customized for use in coating containers having different configurations.

Figure 14:
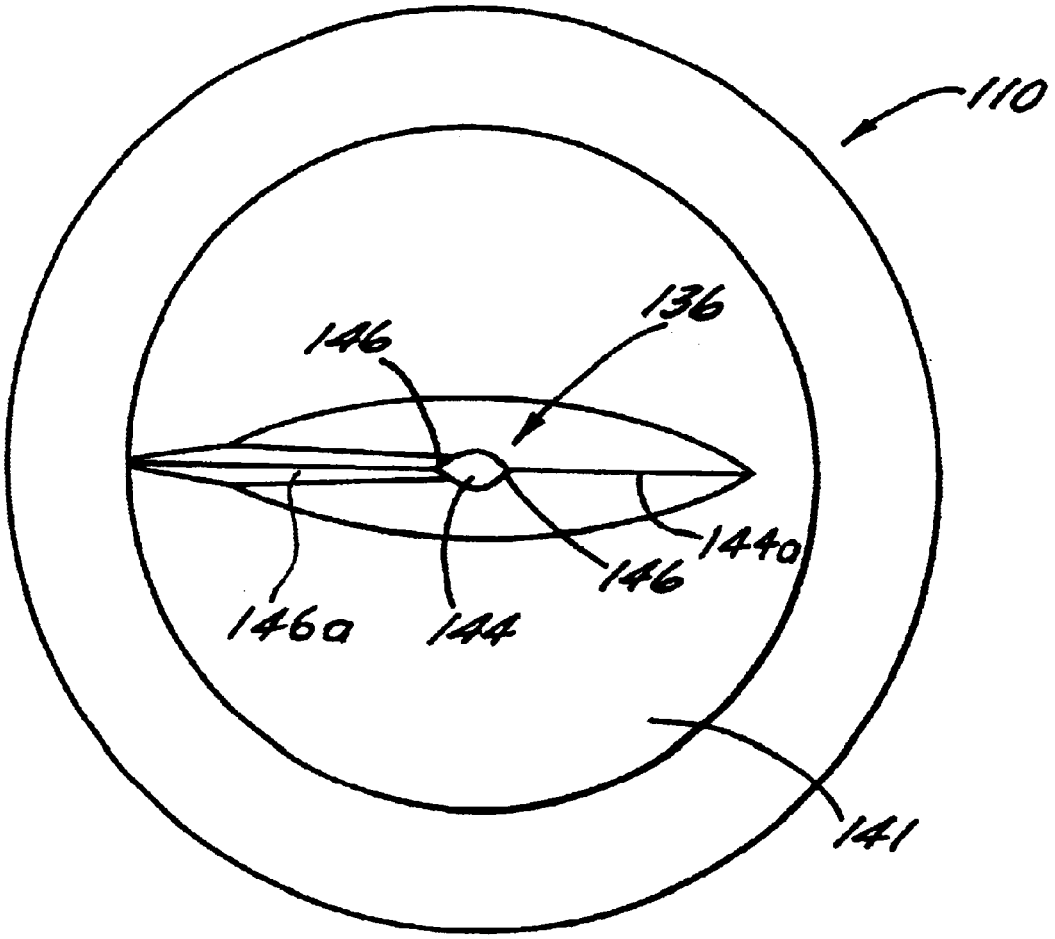
FIG. 14 is a top plan view of an alternative embodiment of a spray nozzle assembly according to the present invention.

A further embodiment of a spray nozzle 110 having an improved asymmetrical discharge distribution is shown in FIG. 14. The spray nozzle 110 of FIG. 14 is specifically configured to produce a discharge pattern 124 in which a thin coat is applied to the majority of the side wall of the container while additional material is applied to the bottom 20 and lower side wall 22 of the container. The additional material on the bottom 20 and lower side wall 22 provides extra protection from exposed metal in those areas that experience the most impact during shipping and storage. However, the nozzle 110 discharges substantially less coating material on the side wall 22 of the container than prior art nozzles used for container coating. Thus, even with the extra coating material on the bottom and lower side wall, the spray nozzle 110 still significantly reduces the consumption of coating material in a container manufacturing operation.

This embodiment of the invention has particular use in coating 12-ounce beverage cans. A typical 12-ounce beverage can has a diameter between 2.39 and 2.88 inches and a height between 4.00 and 5.8 inches. It will be understood, however, that this embodiment of the invention can be used in any application and is not limited solely to 12-ounce beverage can coating operations.

Figure 15:
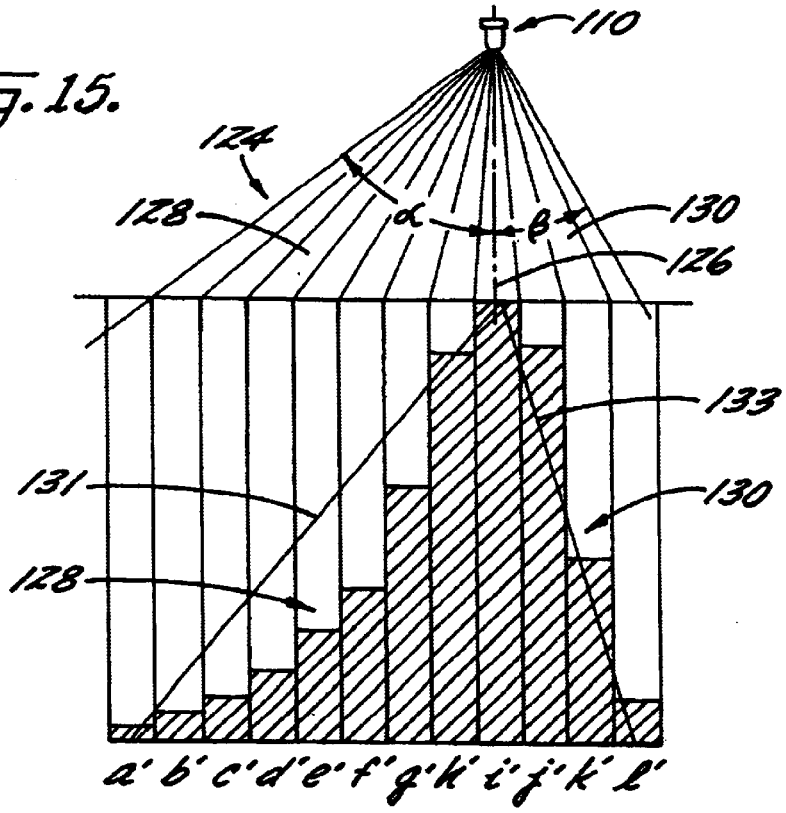
FIG. 15 is a schematic drawing illustrating a fluid distribution pattern for the spray nozzle assembly of FIG. 14.

An exemplary desired distribution pattern for the spray nozzle 110 is schematically shown in FIG. 15. As with the embodiments of the invention shown in FIGS. 1–13 (and the distribution pattern shown in FIG. 5), the maximum fluid discharge (referenced by line 126 is offset from the center of the fluid discharge pattern 124 thereby dividing the discharge pattern into a larger portion 128 and a smaller portion 130. As compared to the distribution pattern shown in FIG. 5, the desired distribution pattern for this embodiment of the invention has more fluid discharge in the troughs (e.g., h' and j') immediately adjacent the location of maximum discharge and in the troughs (e.g, j', k' and i') in the smaller portion 130 of the distribution pattern.

As will be appreciated, these troughs correspond to the lower portion of the side wall 22 and the bottom 20 of the container where the additional coating material is desired. The amount of discharge in the larger portion 128 of the discharge pattern (which as described above generally corresponds to the container side wall 22) tapers to a point of minimum flow at the end of the spray pattern 124. The tapering discharge forms a curve which for a substantial portion thereof is below a line 131 connecting the point of maximum flow and the end of the discharge pattern. Thus, the nozzle produces a substantial savings of coating material as compared to prior art nozzles which taper linearly.

With this embodiment, however, the smaller portion 130 of the discharge pattern 124 does not have such a below linear taper. Instead, the tapering discharge in the smaller portion forms a curve which is generally either along or above a line 133 connecting the point of maximum flow and the end of the discharge pattern. This additional discharge in the smaller portion 130 of the discharge pattern provides the additional coating material on the bottom 120 of the container.

Figure 16:
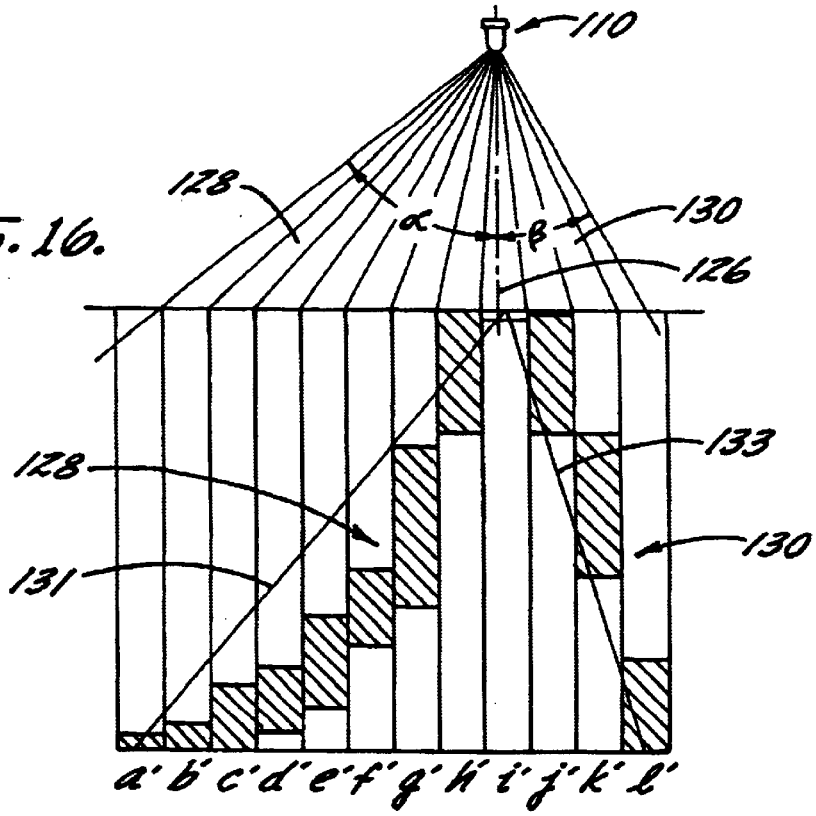
FIG. 16 is a schematic drawing illustrating preferred ranges for the individual troughs in the distribution pattern for the spray nozzle assembly of FIG. 14.

The amount of discharge into the individual troughs can vary within the shaded areas shown in FIG. 16 and still provide the desired distribution pattern. Specifically, with the nozzle spaced 5.72 inches above the distribution table and the nozzle centered over trough i', the ratio of the volume in troughs a'–h' and j'–l' relative to the volume in trough i' can vary as indicated in the following table:

| Trough* | High Value | Low Value |
|---|---|---|
| a' | 0.03 | 0.00 |
| b' | 0.06 | 0.00 |
| c' | 0.15 | 0.00 |
| d' | 0.19 | 0.04 |
| e' | 0.33 | 0.10 |
| f' | 0.43 | 0.25 |
| g' | 0.72 | 0.34 |
| h' | 1.03 | 0.75 |
| i' | 1.00 | 1.00 |
| j' | 1.02 | 0.75 |
| k' | 0.75 | 0.42 |
| l' | 0.22 | 0 |

*Trough width of 1 inch.

Figure 17:
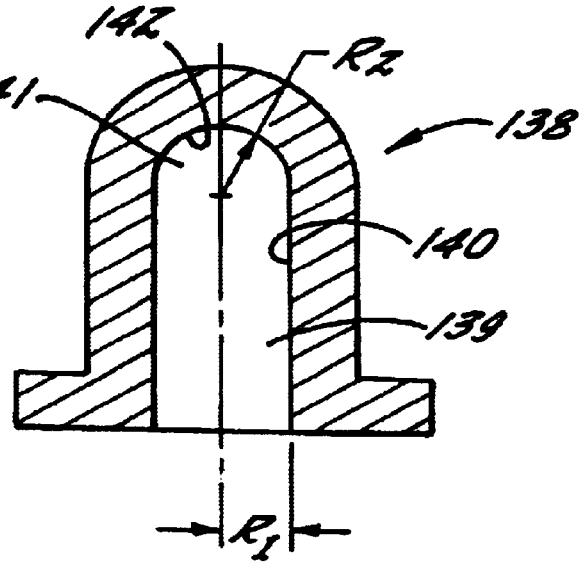
FIG. 17 is a cutaway side elevation view of an illustrative nozzle blank for use in producing the spray nozzle assembly of FIG. 14.

To produce the desired discharge pattern shown in FIGS. 15 and 16, the discharge orifice of the spray nozzle 110 is formed by performing two separate cutting operations on a nozzle blank 138. As shown in FIG. 17, the nozzle blank 138 has a cylindrical portion 139 including a cylindrical side wall 140 and a dome shaped portion 141 terminating in an end wall 142. The cylindrical portion 139 has a radius R1 and the dome shaped portion 141 has a radius R2 and, preferably, the ratio of R2/R1 is between 1.00 and 2.00.

Like the embodiments of the invention described above, one cutting operation is performed using a relatively less sharp cutting edge which produces a relatively wider central portion 144 of the discharge orifice 36. Also, the second cutting operation is performed using a relatively sharper cutting edge which produces one or more narrower peripheral end portions 146 of the orifice. Each of the two cutting operations are centered on and performed in the same plane as the longitudinal axis 148 of the nozzle blank 138 using, in this case, a rotary cutting wheel. However, like the embodiments described earlier, the two cutting operations are performed at different angles relative to the longitudinal axis 148 of the nozzle blank 138. In particular, the cutting operation which uses the relatively sharper cutting edge is performed at a larger angle relative to perpendicular to the longitudinal axis than the cutting operation using the relatively less sharp cutting edge. Accordingly, the edges of the central portion of the discharge orifice extend at a smaller angle relative to perpendicular than the edges of the peripheral end portions of the discharge orifice.

Again, for ease of reference, the two cutting operations will be referred to as first and second cutting operations. However, as will be appreciated, the cutting operations can be performed in any order. Moreover, the cutting operations can be performed either by plunging a cutting wheel into the nozzle blank 138 or by cutting across the blank.

Figure 18:
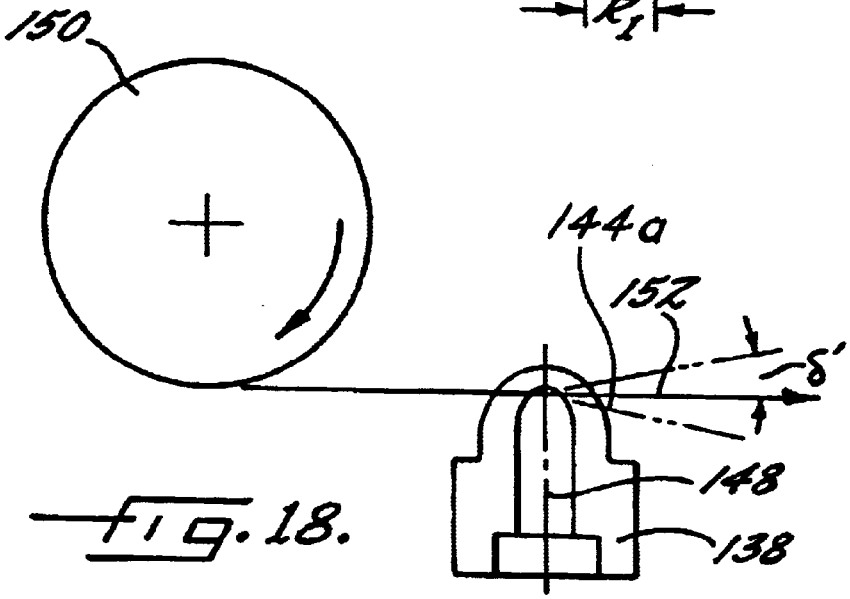
FIG. 18 is a schematic side elevation view showing a cutting path for a first cut used to produce the discharge orifice of the spray nozzle of FIG. 14.
Figure 19:
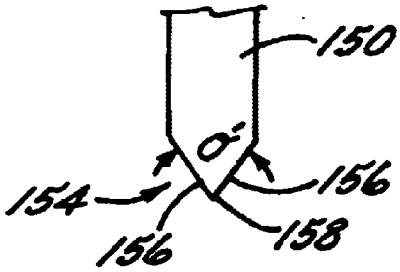
FIG. 19 is an enlarged partial side elevation view of the cutting edge of the cutting wheel of FIG. 18.

The first cutting operation is performed using a cutting wheel 150 equipped with a cutting edge 154 having a pair of angled sides 156 that taper to tip 158 as shown in FIG. 19. Preferably, the angled sides define an included angle $\sigma'$ that is between approximately 40° and 100° with the tip 158 having a radius of less than 0.001 inch. The first cutting operation is preferably performed in a plane perpendicular, or nearly perpendicular, to the longitudinal axis 148 of the nozzle blank 138 such as where the angle $\delta'$ is between 0° and 5° above or below perpendicular (referenced by line 152) as shown in FIG. 18.

Figure 20:
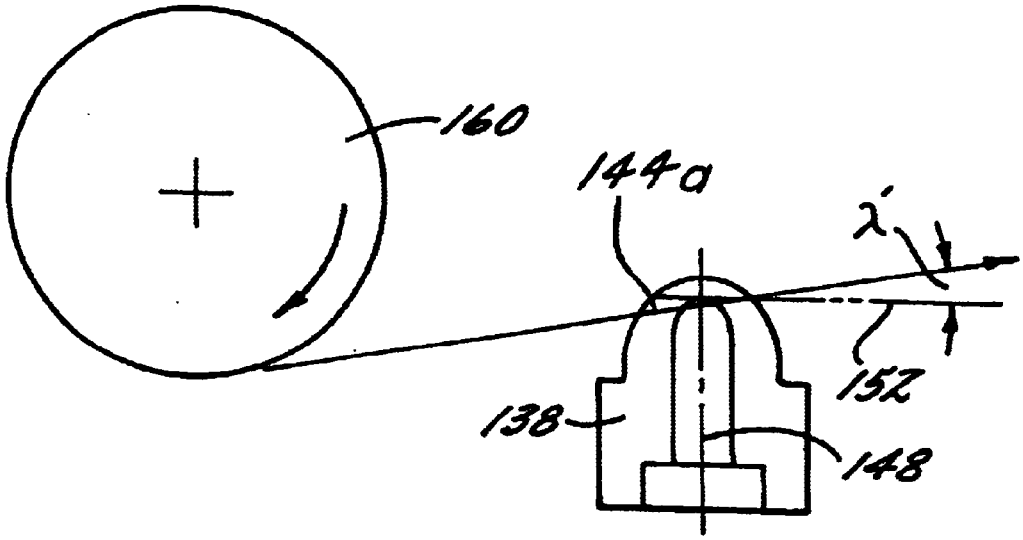
FIG. 20 is a schematic side election view showing a cutting path for a second cut used to produce the discharge orifice of the spray nozzle of FIG. 14.
Figure 21:
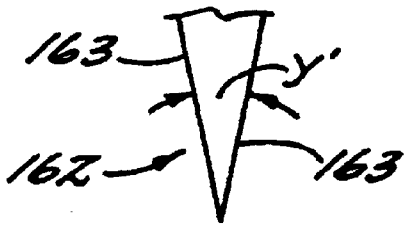
FIG. 21 is an enlarged partial side elevation view of the cutting edge of the cutting wheel of FIG. 19.

For the second cutting operation, a cutting wheel 160 having a relatively sharper cutting edge 162 than the first cutting wheel 150 is used. Specifically, as shown in FIG. 21, the second cutting wheel 160 preferably has angled sides 163 defining an included angle $\gamma'$ of 19° to 35° with a tip 164 having a radius of less than 0.001 inch. Moreover, the second cutting operation is performed in a plane that is at a larger angle relative to perpendicular than the plane in which the first cutting operation is performed. The second cutting operation is preferably performed in a plane that is at angle $\lambda'$ of between 10° and 40° relative to perpendicular as shown in FIG. 20. Using an angle in the range of 35°–40° will result in a distribution pattern that produces less fluid in the first few troughs of the larger portion 128 of the spray pattern (e.g., troughs a'–e'). This can also be accomplished by using a cutting wheel having an included angle 7' at the lower end of the preferred 19°–35° range.

The size or flow rate of the openings produced by the first and second cutting operations should be such that the ratio of the flow rate produced by the first cut to the flow rate produced after the second cut is between 0.85 to 0.95. A nozzle produced using these parameters can have a flow rate ranging between 0.015 gpm at 40 psi to 0.55 gpm at 40 psi.

A spray nozzle produced in such a manner provides an improved distribution of coating material on the interior surfaces of a beverage container. In particular, the nozzle applies a thin even coat to the side wall of the container thereby reducing the consumption of coating material as compared to known container coating nozzles. The nozzle applies additional coating material on the lower side wall and bottom of the container to provide additional protection against impacts that could expose the metal surface.

All of the references cited herein, including patents, patent applications, and publications, are hereby incorporated in their entireties by reference.

While this invention has been described with an emphasis upon preferred embodiments, it will be obvious to those of ordinary skill in the art that variations of the preferred embodiments may be used and that it is intended that the invention may be practiced otherwise than as specifically described herein. Accordingly, this invention includes all modifications encompassed within the spirit and scope of the invention as defined by the following claims.

What is claimed is:

1. A spray nozzle for producing an asymmetrically distributed fluid discharge pattern wherein the location of the maximum fluid discharge is offset from the center of the fluid discharge pattern, the spray nozzle comprising:

a body portion having a longitudinally extending internal fluid passageway which terminates in a substantially hemispherical dome shaped end wall, the fluid passageway having a longitudinal axis, and a discharge orifice formed in said end wall with edges of the discharge orifice being in intersecting relation to an inner side of said dome-shaped end wall, said discharge orifice being defined by first and second openings interposed upon each other, said first opening being relatively rounder than said second opening, said second opening being more elongated than said first opening and extending partially beyond a perimeter of the first opening such that at least a portion the fluid discharge pattern produced by the discharge orifice has a continuous non-linear taper in the amount of fluid discharged from the location of maximum discharge to a point of minimum flow at one end of the discharge pattern so as to form a curve which for a substantial portion thereof is below a line connecting the point of maximum discharge with the point of minimum flow at the one end of the discharge pattern, said relatively rounder first opening being formed by a first elongated slot which extends through said end wall, said first elongated slot having angled sides which define an included angle, said second more elongated opening being defined by a second elongated slot which extends through said end wall having angled sides that define an included angle that is less than the included angle defined by the angled sides of the first elongated slot, said first elongated slot being oriented such that a line extending longitudinally along a bottom of said first elongated slot and through the axis of said longitudinal fluid passageway lies in a first plane, said second elongated slot being oriented that such a line extending longitudinally alone the bottom of the second elongated slot and through the axis of said longitudinal internal fluid passageway lies in a second plane, and said first plane extending at an angle closer to a perpendicular relative to the longitudinal axis of the internal fluid passageway than the second plane.

2. The spray nozzle according to claim 1 wherein the body portion has a cylindrical portion with a first radius and a dome-shaped portion with a second radius wherein the ratio of the second radius to the first radius is between approximately 1 and approximately 2.

3. The spray nozzle according to claim 1 wherein said first opening has opposed sides that define an included angle of between approximately 40° and approximately 100°.

4. The spray nozzle according to claim 1 wherein the second opening has opposed sides that define an included angle of between approximately 19° and approximately 35°.

5. The spray nozzle according to claim 1 wherein the ratio of the flow rate of the first opening to the flow rate produced by the entire discharge orifice is between approximately 0.85 and 0.95.

6. The spray nozzle of claim 1 in which said first and second openings are sized such that the ratio of a flow rate produced by the first opening to a flow rate produced by the entire discharge orifice is between about 0.60 and 0.95.

7. The spray nozzle of claim 1 in which said first and second openings are sized such that a second portion of the discharge pattern produced by the discharge orifice has a taper in the amount of fluid discharged from the location of maximum discharge to a point of minimum flow at a second end of the discharge pattern opposite said one end so as to form a line which for a substantial portion is not below a line connecting the point of maximum discharge with the point of minimum flow at the second end of the discharge pattern.

8. The spray nozzle of claim 1 in which said first and second openings are sized such that a second portion of the discharge pattern produced by the discharge orifice has a taper in the amount of fluid discharged from the location of maximum discharge to a point of minimum flow at a second end of the discharge pattern opposite said one end so as to form a line which for a substantial portion is above a line connecting the point of maximum discharge with the point of minimum flow at the second end of the discharge pattern.

9. The spray nozzle of claim 1 in which said discharge orifice includes a third opening more elongated than said first opening extending partially beyond a perimeter of the first opening on a side of said first opening opposite said second opening, and said third opening being formed by an extension of said second slot through the end of said in wall.

* * * * *